US005909067A

United States Patent [19]

Liadakis

[11] Patent Number: 5,909,067

[45] Date of Patent: Jun. 1, 1999

[54] MOTOR VEHICLE STARTER CONTACTOR INCORPORATING AN AUXILIARY CONTROL RELAY

[75] Inventor: André Liadakis, Salagnon, France

[73] Assignee: Valeo Equipements Electriques Moteur, Creteil, France

[21] Appl. No.: 08/922,545

[22] Filed: Sep. 3, 1997

[30] Foreign Application Priority Data

Sep. 3, 1996 [FR] France ..... 96 10820

[51] Int. Cl.[6] ..... H01H 67/02; F02N 11/00; F02N 15/06

[52] U.S. Cl. ..... 310/14; 310/179; 310/67 R; 310/12; 310/13; 290/48; 290/38 R; 290/38 A; 74/7 C; 335/126; 335/131

[58] Field of Search ..... 310/14, 179, 71, 310/83, 13, 17, 12, 67 R; 74/6, 801, 7 A, 7 C, 7 R, 7 E; 290/48, 38 A, 38 R, 38 C; 335/126, 131, 106, 133

[56] References Cited

U.S. PATENT DOCUMENTS

| | | | |
|---|---|---|---|
| 4,852,417 | 8/1989 | Tanaka | 74/7 E |
| 5,196,727 | 3/1993 | Isozumi et al. | 290/48 |
| 5,227,751 | 7/1993 | Shiroyama et al. | 335/126 |
| 5,424,700 | 6/1995 | Santarelli | 335/126 |
| 5,677,656 | 10/1997 | Mauch et al. | 335/126 |
| 5,703,551 | 12/1997 | Lefebvre et al. | 335/126 |

FOREIGN PATENT DOCUMENTS

| | | |
|---|---|---|
| 2 724 421 | 3/1996 | France . |
| 42 42 930 | 6/1994 | Germany . |
| 44 32 297 | 3/1996 | Germany . |

OTHER PUBLICATIONS

French Search Report dated Jun. 6, 1997.

*Primary Examiner*—Thomas M. Dougherty
*Assistant Examiner*—Tran N Nguyen
*Attorney, Agent, or Firm*—Morgan & Finnegan, LLP

[57] ABSTRACT

A contactor for a motor vehicle starter comprises a contactor coil, a movable contactor core actuated by a control rod, and a fixed contactor core. It also has an electromagnetic auxiliary control relay which includes a movable relay core carrying a movable contact ring which is arranged for cooperation with at least one pair of fixed relay contacts, carried by a fixed annular contact carrier plate. The relay coil, the contact carrier plate, and the movable contact ring are arranged in axial succession, in that order towards the front of the contactor, and are disposed between the movable contact of the contactor and the fixed core, so that the relay and the contactor are closed in the same, forward, direction.

20 Claims, 1 Drawing Sheet

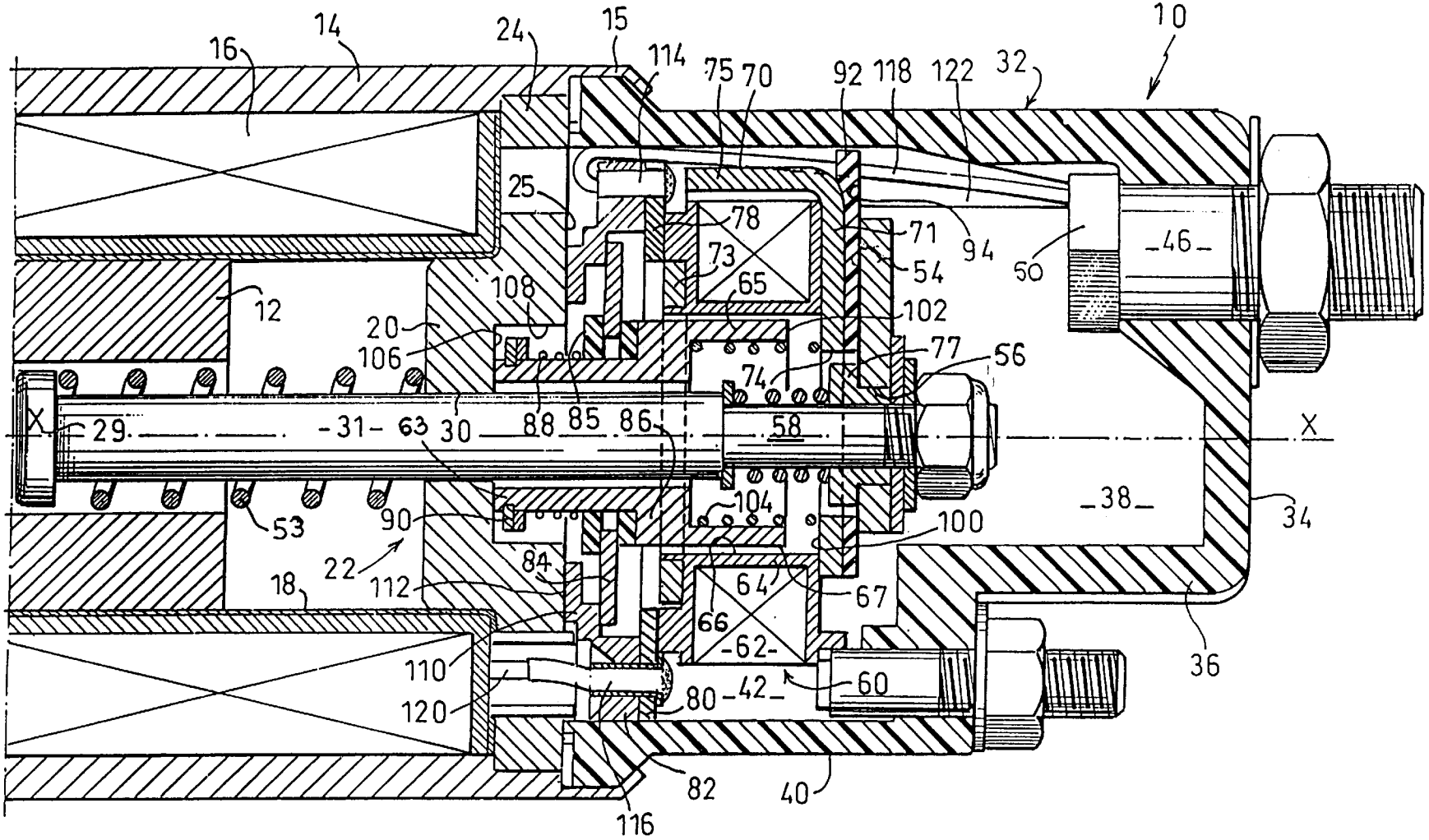
10
32
122
118
92
70
75
114
15
24
14
16
12
20
106
108
25
78
73
65
71
54
102
94
46
50
56
77
74
58
88
85
86
30
63
31
29
X
38
34
36
100
104
67
64
66
62
42
60
40
80
82
116
84
90
112
22
18
53
110
120

MOTOR VEHICLE STARTER CONTACTOR INCORPORATING AN AUXILIARY CONTROL RELAY

FIELD OF THE INVENTION

The present invention relates to motor vehicle starter contactors. More particularly, the invention relates to a contactor for a motor vehicle starter, of the type comprising an annular cylindrical armature, in which is arranged a solenoid coil, or contactor coil, that actuates an axially movable contactor core. This movable core acts on a control rod which extends through the centre of a fixed core in the form of a disc disposed at a front axial end of the armature. The control rod governs displacements of a movable contact, or movable contactor contact, which is adapted to cooperate with two fixed contacts, forming part of the power terminals connected in the power supply circuit for the motor of the starter. These fixed contact terminals are arranged in the base portion of an end cover that forms part of the casing of the contactors. A lateral skirt portion of the end cover defines an end cap chamber in which the movable contact is mounted, this chamber being part of the internal chamber of the contactor casing.

BACKGROUND OF THE INVENTION

In a known design of starter contactor, the contactor is controlled by an electromagnetic auxiliary relay which enables commands for controlling the contactor to be transmitted by means of a low current. As a result, the ignition switch of the vehicle no longer has to support a current of high intensity, which may typically be several tens of amperes: a current of the order of 1 ampere is perfectly sufficient to ensure proper control of the contactor. Thanks to this arrangement, it is possible to reduce the dimensioning of the wiring and of the ignition switch associated with the ignition key.

In addition, a starter having an auxiliary control relay for the contactor can be governed easily and inexpensively by an electronic control circuit which may, in particular, taken into account information relating to the locking of the steering lock of the vehicle, and which can include a control and safety system which takes care of any electrical overloads occurring in the operation of the starter.

In known designs, the auxiliary relay is typically fixed outside of the contactor, e.g. on the contactor itself; the relay may for example be carried on the starter casing or on the pedestal of the starter motor, or on an element of the bodywork of the vehicle.

In all the above mentioned cases, the auxiliary control relay has its own protective housing, with its own sealing means and its own wiring by which it is connected electrically to the control circuit and to the contactor. These designs therefore lead to particularly high costs, and to additional space requirements in the engine compartment of the vehicle.

With a view to incorporation of the relay within the contactor, and in order to overcome the problems just mentioned, it has previously been proposed to provide a contactor in which the end cap or cover of the contactor casing includes a chamber in which the auxiliary control relay is mounted. This design does enable the auxiliary relay to be protected, and reduces the length required for the various connecting cables.

In order to improve still further the incorporation of the auxiliary control relay into the contactor, it was proposed in French patent specification No. FR 2 724 421 A to provide a contactor which includes an auxiliary electromagnetic control relay mounted in the chamber in the end cap, between the fixed core and the movable contact of the contactor. The auxiliary relay includes a relay coil of generally annular form, within which a movable relay core is guided in axial sliding movement. The control rod extends through the centre of this movable relay core, and the latter carries a movable relay contact ring which, under the action of the relay coil, is adapted for cooperation with at least one pair of fixed relay contacts carried by a fixed, annular, contact carrier plate of insulating material. The contactor is further of a type in which the movable relay core is biassed resiliently towards an axial rest position.

In the design proposed in the above mentioned French patent specification, the auxiliary control relay, which generally has the form of a body of revolution, and through which the control rod for the movable contact of the contactor passes, is made in the form of a separate, attached, sub-assembly which is fixed by means of screws on the fixed magnetic core of the contactor.

Apart from the fact that the specific assembly operations for fitting the auxiliary control relay on the contactor are relatively complex, this design, taking the form of an independent component fitted in the interior of the contactor, results in a significant increase in the axial length of the contactor and also in its weight.

In addition, the detail design of the auxiliary control relay proposed in the above mentioned French patent specification makes it necessary, in order to determine the rest position of the movable contact ring of the auxiliary control relay, to make use of a stack of opposed springs, with precise axial dimensioning of the various components. It is therefore particularly difficult to determine reliably the axial rest position of the movable relay contact, and such a design makes it necessary to manufacture certain of the components of the auxiliary relay with very great precision.

DISCUSSION OF THE INVENTION

An object of the present invention is to propose an improvement in the design of a contactor of the type mentioned above, that is to say of the general type described and shown in French patent specification No. FR 2 724 421 A, such as to overcome the drawbacks just discussed.

According to the invention in a first aspect, a contactor for a motor vehicle starter, of the type having a casing comprising an annular cylindrical armature and an end cap, with, arranged within the armature, a contactor coil consisting of a solenoid coil that actuates an axially movable contactor core which acts on a control rod which extends through the centre of a fixed contactor core in the form of a disc disposed at a front axial end of the armature, being also of the type in which the control rod governs displacements of a movable contactor contact which is adapted to cooperate with two fixed power contact terminals for connection to the power supply circuit for the motor of the starter, the said fixed power contact terminals being arranged in the base portion of the end cap, a lateral skirt portion of which defines an end cap chamber in which the movable contactor contact is mounted, the contactor being further of the type comprising an auxiliary electromagnetic control relay which is mounted in the chamber in the end cap, between the fixed core and the movable contact of the contactor, the auxiliary relay including a relay coil of generally annular form, within which there is guided in axial sliding movement a movable relay core through the centre of which the control rod extends, the movable relay core carrying a movable contact ring which, under the action of the relay coil, is adapted for cooperation with at least one pair of fixed relay contacts carried by a fixed, annular, contact carrier plate of insulating material, the contactor being further of the type in which the movable relay core is biassed resiliently towards an axial rest position, is characterised in that the relay coil and the contact carrier plate are mounted in axial succession in that order from front to rear, being disposed between the movable contact of the contactor and the fixed core.

According to a preferred feature of the invention, the movable relay coil is biassed axially towards a fixed stop abutment defined by a portion of the fixed core in facing relationship with the movable relay core.

According to another preferred feature of the invention, the relay coil and the annular contact carrier plate constitute an axial stack of components interposed between the transverse front end face of the fixed core of the contactor and a transverse shoulder of the end cap of the contactor, the said transverse shoulder being oriented towards the rear. Preferably with this arrangement, the said axial stack of components includes an elastically compressed intermediate member. The said elastically compressed member is preferably an annular element which is mounted in axial compression between the said rear transverse shoulder of the end cap and the relay coil.

According to a further preferred feature of the invention, the movable relay core is biassed axially towards its rest position by a compression spring through which the control rod passes, the compression spring being interposed between the relay coil and the movable core of the relay.

The movable relay core is preferably a hollow cylindrical sleeve which carries the movable contact ring. In preferred embodiments of this arrangement, the movable contact ring is adapted to be displaced axially with respect to the said sleeve towards the rear of the contactor, from a rest position towards which it is resiliently biassed by a spring for limiting the force applied between the movable contact ring and the fixed relay contacts.

According to a further preferred feature of the invention, the relay coil includes an annular magnetic yoke which, in cross section through a transverse plane, has an L-shaped profile defining a first branch extending axially at the periphery of the coil, the other or second branch of the yoke extending radially inwardly. In preferred embodiments with this feature, the said radially oriented branch is part of a front radial plate portion of the yoke, the front transverse face of which constitutes an abutment surface against which the movable contactor contact is biassed resiliently to a rest position.

In these last mentioned preferred embodiments of the invention, and where the contactor includes a resilient, annular element in axial compression between the rear transverse shoulder of the end cap and the relay coil, as mentioned above, then in accordance with a further preferred feature, the inner radial portion of the said resiliently compressed annular element is interposed axially between the transverse front face of the front radial plate portion of the yoke and the movable contactor contact. In preferred versions of this particular arrangement, the internal radial portion of the rear face of the front radial plate portion of the yoke constitutes an annular abutment surface with which the front axial terminal edge of the movable core of the auxiliary control relay is in cooperation when the auxiliary relay is energised.

Preferably, where the relay coil and the annular contact carrier plate constitute an axial stack of components interposed between the transverse front end face of the fixed core of the contactor and a transverse shoulder of the end cap of the contactor, the said transverse shoulder being oriented towards the rear, the contact carrier plate is adjacent to the magnetic yoke of the relay coil, and is extended centrally by a tubular portion, the rear terminal end of which bears against the transverse front end face of the fixed core of the contactor, so as to constitute a tubular spacer interposed between the fixed core and the relay coil.

According to the invention in a second aspect, a motor vehicle starter is equipped with a contactor in accordance with the first aspect of the invention.

Further features and advantages of the invention will appear more clearly on a reading of the following detailed description of one preferred embodiment of the invention, which is given by way of non-limiting example only and with reference to the accompanying drawing.

BRIEF DESCRIPTION OF THE DRAWING

The single FIGURE of the drawing is a view in axial cross section showing a starter contactor in accordance with the invention.

DESCRIPTION OF A PREFERRED EMBODIMENT OF THE INVENTION

The electromagnetic contactor 10 shown in the drawing is arranged to equip a starter (not shown) for a motor vehicle internal combustion engine.

In a manner known per se, the contactor 10 includes a movable contactor core 12 which acts on one end of a pivoting lever (not shown), the other end of which is coupled to the driving element of the starter head of the starter. The electromagnetic contactor 10 also has an external armature 14, which may also be referred to as the barrel or the casing body, and which is of annular generally cylindrical form with an axis X—X. Disposed inside the barrel 14 is, in particular, an solenoid coil 16, also referred to here as the contactor coil or solenoid winding.

The movable core 12 is mounted for sliding movement within a tubular skirt 18 which is fixed on the central portion 20 of a fixed contactor core 22. The fixed core 22 is generally in the form of a disc having a flat annular main portion 24 which lies in a transverse plane at right angles to the axis X—X, with the solenoid coil 16 and the tubular skirt 18, in the rear part of the external armature 14.

The barrel 14 is extended axially forward, that is to say towards the right in the drawing, beyond the transverse front end face 25 of the disc-shaped main portion 24 of the fixed core 22, by a thin extension portion 15, the function of which will be explained later in this description.

The central portion 20 of the fixed core 22 has a central through hole 30, for guiding, in sliding movement on the axis X—X, a control rod 31 on which the movable core 12 acts.

The contactor has a casing which consists generally of the barrel 14 and an end cap 32 which is fixed to the open front end of the barrel 14. The end cap 32 is a moulded component made from a suitable insulating material, for example a thermoplastics material. The end cap 32 is in the general form of a cylindrical pot centred on the axis X—X, and comprises a radially extending terminal base portion 34 lying at right angles to the axis X—X, with a cylindrical side wall or skirt portion 36 projecting from the base portion 34.

The main part of the skirt portion 36 defines a cylindrical internal chamber 38 of the contactor, and in particular an end cap chamber. The rear end portion 40 of the skirt 36, having the largest diameter of the latter, defines an internal cavity 42 of generally cylindrical form, which is bounded on its rear side by the front transverse face 25 of the disc-shaped main portion 24 of the fixed contactor core 22. The front end 28 of the barrel 14 is extended by a thin axial end portion 15, which is upset radially inwards over an external terminal bead of the end cap skirt portion 36, thereby sealingly securing the end cap 32 and armature 14 together.

In a manner known per se, the contactor 10 has two fixed power terminals of electrically conductive material. One of these, namely a power terminal 46, is seen in the upper part of the drawing. The power terminals 46 and 48, which are encapsulated in the moulding of the base portion 34 of the end cap 32. Each fixed power terminal has an exposed contact head 50, within the chamber 38 and oriented generally in a plane at right angles to the axis X—X.

Again in a manner known per se, the control rod 31 carries a movable contactor contact 54, in the form of a rectangular plate which has a central through hole 56. The control rod 31 has a portion 58 which extends through this hole 56.

In the rest position shown in the drawing, the movable core 12, the control rod 31 and the movable contact 54 of the contactor are biassed resiliently, towards the left in the drawing, by a return spring 53 which is interposed between the fixed core 22 and a head 29 of the control rod 31 at the rear end of the latter.

The contactor 10 is equipped with an auxiliary control relay 60. This auxiliary control relay 60 includes a relay coil 62 which consists of a winding arranged in a coil housing or body 64. As can be seen in the drawing, the transverse cross section of the coil body 64 is substantially U-shaped, with parallel branches which extend radially outwardly, while the central portion, joining these two parallel branches together, defines a central bore 66 of the coil body 64. A movable core 67 of the relay 60 is mounted in the central bore 66 for sliding movement. The movable core 67 is in the form of a stepped sleeve, the rear portion of which, having the largest diameter, is guided in sliding movement within the body 64 of the coil 62 of the auxiliary control relay 60.

The coil body 64 is surrounded by a magnetic circuit which consists of a magnetic yoke 70 in the form of an annular metallic member with an L-shaped transverse cross section. The L-shaped cross section of the yoke 70 comprises an axial branch 75 and a radial branch. The free rear end of the axial branch 75 is in axial abutment against the transverse front end face 25 of the fixed core 22 of the contactor 10.

The other branch of the L-shaped cross section of the yoke 70 extends radially in a transverse plane, and constitutes a front radial plate portion 71 of the yoke. The inner free end 74 of the plate portion 71 is adjacent to a guide bush 77 oriented on the axis X—X. There is a radial clearance between the inner end 74 and the guide bush 77. The front portion 58 of the control rod 31 extends through the guide bush 77, and the latter carries the movable contactor contact 54 for axial sliding movement of the latter on the control rod end portion 58, which is of smaller diameter than the remainder of the control rod 31.

The inner radial portion of the rear face 100 of the front radial plate portion 71 extends radially inwardly beyond the coil housing or body 64, so as to constitute an annular abutment surface with which the annular front axial end 102 of the movable relay contact 67 is able to cooperate.

The magnetic yoke 70 is "closed" by a rear radial plate 73 which has a central hole, and which is also formed with locating recesses for the positioning of the yoke 70 and the coil body 64 relative to each other.

The movable relay core 67 is biased elastically forward (i.e. towards the left in the drawing) towards its rest position, by a helical compression spring 104 which is interposed axially between the base of the front end portion 65 of the movable relay core 67 (which is of larger diameter than the remainder of the movable relay core 67) and the annular abutment surface 100 of the front radial plate portion 71 of the yoke 70. This rest position of the movable relay core 67 is determined by its annular rear axial end coming into abutment against a facing abutment surface constituted by the base 106 of a central cylindrical recess 108 formed in the front face 25 of the fixed core 22.

One end of the winding of the relay coil 62 is connected to ground or earth, represented by the metal structure of the contactor, on the fixed core 22 of the latter.

The auxiliary control relay 60 also has two fixed contacts 78 and 80, which may for example be diametrically opposed to each other and which are carried by an annular contact carrier plate 82 which is interposed axially between the fixed core 22 and the yoke 70. The fixed relay contacts 78 and 80 extend radially inwardly, close to the movable core 67, which carries a movable contact ring 84 of the relay. This contact ring 84 surrounds the rear portion 63, i.e. the portion having the smallest diameter, of the stepped sleeve that constitutes the movable core 67 of the auxiliary relay. The contact ring 84 is mounted on this front portion of the sleeve for axial movement.

The movable contact ring 84 is fitted in an insulating internal guide ring 85. The contact ring 84, with its guide ring 85, is biassed axially into abutment against the external radial shoulder 86 of the movable relay core 67 which is defined by the junction between the two portions of the movable relay core having different diameters. This biassing action is exerted by a spring 88, which bears at its other end against a resilient ring 90 fixed on the movable relay core 67. The purpose of the spring 88 is to limit the force applied between the contact ring 84 and the fixed contacts 78 and 80 when the auxiliary control relay 60 is closed, in order to avoid crushing and deformations, both of the fixed contacts 78 and 80 and of the movable contact ring 84.

The contact carrier plate 82 is extended axially towards the rear by a stepped, tubular central portion 110 having an annular rear axial end face 112 which abuts against the front face 25 of the fixed core 22, so that the carrier plate 82 acts as a spacer between the fixed core 22 and the yoke 70, that is to say between the front face 25 of the fixed core 22 and the rear face of the radial rear plate portion 73 of the yoke 70.

The fixed contacts 78 and 80 are fixed on the carrier plate 82 by means of rivets 114 and 116. Each of these rivets is hollow so that an electrical connecting wire 118 or 120 can be passed through it. The wire 118 connects the fixed contact 78 to the contactor power contact 46, while the wire 120 connects the fixed relay contact 80 to the solenoid coil 16.

The axial stack consisting of the relay coil 62, the contact carrier plate 82 that carries the contacts 78 and 80, and the movable core 67 with its movable contact ring 84, is retained axially in the cavity 42 which is that part of the internal chamber 38 of the contactor having the largest diameter, by means of a retaining and abutment ring 92. This ring 92 has the general form of a rigid annular disc, and it bears axially at the front against a radial internal shoulder 94 of the end cap 32. This shoulder 94 is oriented axially towards the rear, i.e. towards the left in the drawing. The shoulder 94 consists of the rear axial terminal edges of a set of internal ribs 122 of the end cap 32. The retaining and abutment ring 92 is elastic, that is to say it is mounted in axial compression between the shoulder 94 and the front face of the front radial plate portion 71 of the yoke 70.

Once the various components of the contactor have been assembled, and after the thin extension portion 15 of the barrel 14 has been upset so as to seam together the barrel and the end cap 32, the retaining and abutment ring 92, in engagement against the transverse front face 25 of the fixed core 22, holds the stack of components consisting of the relay coil 62 and the contact carrier plate 82 in axial compression.

Actuation of the auxiliary control relay 60, from its rest position shown in the drawing, is obtained by energising the relay coil 62. This causes the movable relay core 67 of the auxiliary relay to be displaced axially forward, that is to say from left to right with reference to the drawing. This moves the movable contact ring 84 forward until it comes into abutment against the facing portions of the fixed contacts 78 and 80.

As has been mentioned above, the spring 88 prevents these contacts from being crushed in use.

What is claimed is:

1. A motor vehicle starter contactor, comprising:

a casing comprising a cylindrical armature having an open front end and a hollow end cap secured on the front end of the armature, the end cap having a base portion and a lateral skirt portion extending from the base portion and defining within the end cap an internal chamber open towards the interior of the armature, the casing defining a contactor axis;

a pair of fixed power contacts carried by the base portion of the end cap;

an axially movable contactor contact within the internal chamber;

a control rod extending axially in the internal chamber and carrying the movable contactor contact;

a fixed contactor core in the form of a disc mounted radially in the front end of the armature, the fixed contactor core having a central hole mounting the control rod for axial displacement of the control rod, displacement of the control rod carrying the movable contactor contact into and out of engagement with the fixed power contacts;

a movable contactor core mounted to effect said axial displacement of the control rod;

a contactor coil mounted in the armature for actuating the axial displacement of the movable contactor core;

an auxiliary relay, comprising an auxiliary relay coil, a movable relay core carrying an auxiliary moveable contact, and a contact carrier plate carrying an auxiliary fixed contact, the auxiliary relay contacts controlling current to effect the axial displacement of the control rod, the movable relay core being symmetrically disposed along the contactor axis;

the auxiliary relay coil, contact carrier plate being mounted, in that order in rearward axial succession, between the movable contactor contact and the fixed contactor core.

2. The contactor according to claim 1, wherein the fixed contactor core includes a portion in facing relationship with the movable relay core and defining a fixed stop abutment, the contactor further including means biasing the movable relay core towards the fixed stop abutment.

3. The contactor according to claim 2, wherein the auxiliary relay coil and the contact carrier plate constitute an axial stack of components, the end cap having a rearwardly oriented transverse shoulder, the fixed contactor core having a transverse front end face, and the stack being interposed between the front end face of the fixed contactor core and the transverse shoulder of the end cap.

4. The contactor according to claim 3, wherein the stack of components further includes an elastically compressed intermediate member.

5. The contactor according to claim 4, wherein the elastically compressed intermediate member is an annular element mounted in axial compression on the auxiliary relay coil.

6. The contactor according to claim 3, wherein the auxiliary relay coil includes an annular magnetic yoke, the fixed contactor core having a transverse front end face, the contact carrier plate being adjacent to the yoke and having a central portion, the contact carrier plate further having a tubular portion extending its central portion and having a rear terminal edge bearing against the transverse front face of the fixed contactor core, the contact carrier plate spacing the the fixed contactor core from the auxiliary relay coil.

7. The contactor according to claim 1, further including a compression spring interposed between the auxiliary relay coil and the movable relay core, the control rod extending through the compression spring, the compression spring engaging the movable relay core to bias the latter elastically to a rest position.

8. The contactor according to claim 1, wherein the movable relay core is a hollow cylindrical sleeve, and the movable contact includes an annular movable contact ring carried on the cylindrical sleeve.

9. The contactor according to claim 8, wherein the hollow cylindrical sleeve defines a rest position of the movable contact ring with respect to the sleeve and carries the movable contact ring for rearward axial displacement of the latter on the sleeve from the rest position, the relay further including a force limiting spring biasing the movable contact ring towards the rest position, so as to limit pressure between the movable contact ring and the fixed relay contacts.

10. The contactor according to claim 1, wherein the auxiliary relay coil includes an annular magnetic yoke having an L-shaped profile in transverse cross section, to define an axial first branch and a radial second branch, the first branch extending axially at the periphery of the auxiliary relay coil, the second branch extending radially inwardly.

11. The contactor according to claim 10, wherein the yoke includes a radial front plate portion constituting the second branch and having a front transverse face defining an abutment surface, the contactor further including biasing means for biasing the movable contactor contact into engagement against the abutment surface in a rest position.

12. The contactor according to claim 11, wherein the fixed contactor core includes a portion in facing relationship with the movable relay core and defining a fixed stop abutment, the contactor further including means biasing the movable relay core towards the fixed stop abutment, wherein the auxiliary relay coil and the contact carrier plate constitute an axial stack of components, the end cap having a rearwardly oriented transverse shoulder, the fixed contactor core having a transverse front end face, and the stack being interposed between the front end face of the fixed contactor core and the transverse shoulder of the end cap, wherein the stack of components further includes an elastically compressed intermediate member, and wherein the elastically compressed intermediate member is an annular element mounted in axial compression between the rear transverse shoulder of the end cap and the auxiliary relay coil, the annular element having a radially inner portion interposed between the front radial plate portion of the yoke and the movable contact of the contactor.

13. The contactor according to claim 12, wherein the front plate portion of the yoke has a rear face constituting an annular abutment surface, the movable relay core having an axial terminal front edge, the relay being adapted so that when the auxiliary relay coil is energized, the axial terminal front edge of the movable relay core cooperates with the annular abutment surface.

14. A motor vehicle starter including a contactor according to claim 1.

15. A motor vehicle starter contactor, comprising:

a casing, a fixed power contact in an end cap of the casing, a primary movable contact for making a circuit with the fixed power contact, a control rod extending on an axis of the contactor and carrying the primary movable contact; and an auxiliary relay, comprising an auxiliary relay coil, an auxiliary relay core carrying a secondary moveable contact, and a contact carrier plate carrying a secondary fixed contact; the secondary moveable and secondary fixed contacts controlling current to effect axial displacement of the control rod to make the contact between the fixed power contact and the primary movable contact;

the auxiliary relay core being symmetrically disposed about the contactor axis, the contact carrier plate being mounted between the auxiliary relay coil and a fixed contactor core.

16. The contactor according to claim 15, further including a resilient member biasing the movable relay core into abutment with the fixed contactor core.

17. The contactor according to claim 16, the resilient member being a compression spring mounted in a cavity of the movable relay core and surrounding the control rod.

18. The contactor according to claim 15, wherein the auxiliary relay coil is mounted between the contact carrier plate and an elastically compressed intermediate member.

19. The contactor according to claim 15, wherein the secondary movable contact includes an annular movable contact ring carried on a cylindrical sleeve of the movable relay core.

20. The contactor according to claim 19, further including a force limiting spring biasing the movable contact ring towards a rest position, so as to limit pressure between the movable contact ring and a fixed contact of the auxiliary relay.

* * * * *